US009587439B2

(12) United States Patent
Lamik-Thonhauser et al.

(10) Patent No.: US 9,587,439 B2
(45) Date of Patent: Mar. 7, 2017

(54) ELECTRICAL TRIPPING SUB FOR WIRED DRILL PIPES

(71) Applicant: think and vision GmbH, Leoben (AT)

(72) Inventors: Bouchra Lamik-Thonhauser, Gai (AT); Anton Kotov, Samara (RU); Alexander Fine, Leoben (AT)

(73) Assignee: think and vision GmbH, Leoben (AT)

( * ) Notice: Subject to any disclaimer, the term of this patent is extended or adjusted under 35 U.S.C. 154(b) by 276 days.

(21) Appl. No.: 14/084,431

(22) Filed: Nov. 19, 2013

(65) Prior Publication Data

US 2014/0144651 A1 May 29, 2014

(30) Foreign Application Priority Data

Nov. 28, 2012 (EP) ..... 12194531

(51) Int. Cl.
*E21B 47/12* (2012.01)
*E21B 17/02* (2006.01)

(52) U.S. Cl.
CPC ..... *E21B 17/028* (2013.01)

(58) Field of Classification Search
CPC ..... E21B 17/028; E21B 17/003; E21B 47/12
See application file for complete search history.

(56) References Cited

U.S. PATENT DOCUMENTS

| | | | | |
|---|---|---|---|---|
| 6,670,880 | B1 | 12/2003 | Hall et al. | |
| 7,198,118 | B2 | 4/2007 | Hall et al. | |
| 8,056,619 | B2 * | 11/2011 | Patel | E21B 17/028 166/242.7 |
| 2008/0159077 | A1 * | 7/2008 | Madhavan | E21B 17/028 367/76 |
| 2010/0243325 | A1 | 9/2010 | Veeningen | |
| 2012/0067594 | A1 * | 3/2012 | Noske | E21B 34/08 166/373 |

FOREIGN PATENT DOCUMENTS

| | | | |
|---|---|---|---|
| EP | 2 273 058 | A2 | 1/2011 |
| WO | WO 2010/141969 | A2 | 12/2010 |

* cited by examiner

*Primary Examiner* — Catherine Loikith
(74) *Attorney, Agent, or Firm* — Knobbe, Martens, Olson & Bear, LLP

(57) ABSTRACT

A device for connecting at least one electrical data and/or supply line to electrical sockets of a wired drill pipe is disclosed. One inventive aspect of the device comprises: a collet blocking plug axially insertable into and removable from a receiver end of the drill pipe and at least one collet. The collet is configured to be interlocked with the drill pipe in a locking position and be released from the drill pipe in a release position. The collet is axially displaceable from the collet blocking plug between the locking position and the release position. The collet blocking plug is axially insertable into and removable from a receiver end of the drill pipe.

22 Claims, 16 Drawing Sheets

ELECTRICAL TRIPPING SUB FOR WIRED DRILL PIPES

CROSS REFERENCE TO RELATED APPLICATIONS

This application claims benefit under 35 U.S.C. §119 to European Patent Application No. 12194531.5 entitled "Electrical Tripping Sub for Wired Drill Pipes" filed on Nov. 28, 2012, the disclosure of which is hereby incorporated by reference in its entirety.

FIELD

The disclosed technology relates generally to wired drill pipes. More specifically, the disclosure is directed to systems, methods, and devices for connecting at least one electrical data and/or supply line to electrical sockets of a wired drill pipe when the drill pipe is not in an active drilling operation.

BACKGROUND

Currently, simple steel pipes are screwed together in many drilling facilities. In this manner, a drill string is formed to be several kilometers long and a drill bit is attached at an end of the drill string. In an interior of the pipes, there is a rinsing fluid (e.g., mud) for fulfilling a variety of functions during a drilling process. One of those functions may be an transmission of data via pressure pulses. However, since this data transmission is slow (e.g., a typical transmission rate is around 10 Baud), increasing efforts have been undertaken in drilling industries for obtaining bore information during a drilling operation at higher data transmission rates. For example, a downhole data transmission system of U.S. Pat. No. 6,670,880 is shown to transmit data through a plurality of drilling components of a drill string. Each of the drilling components is connected at its two ends to ends of subsequent drilling components. A coaxial cable within each drilling component extends from one end to the other end of the drilling component and is connected to the coaxial cables of adjacent drilling components. During a drilling operation, a swivel enables communications between the downhole data transmission system and instruments positioned at surface. Other transmission mechanisms are also used. For example, sonar or electric currents across the soil, etc. However, solutions based on a wiring of the drill string (e.g., electrical cables or light guides) have turned out to be most efficient.

Logging of data from the bore during a drilling process has become an essential element in modern crude oil, natural gas or geothermal drillings. This type of data acquisition is also referred to as Measurement While Drilling (MWD) or Logging While Drilling (LWD). Data acquisition is also important for a construction of the bore and a subsequent production of crude oil, gas and/or warm water. A drilling can be operated safely, efficiently and economically only by accurately determining respective relevant measurements. More data from below ground are available, more efficiently and safely can a drilling operation be organized. Therefore, the drilling industry increasingly demands a transmission of data at high data rates (e.g., 200 kBaud) from a depth of several kilometers. This request results in increasing demands on the power of underground measuring units and therefore, an increase in the electric power consumption of the underground measuring units. In order to account for this increasing electric power consumption, the underground measuring units should be supplied with electric energy (e.g., with 200 W) also from the surface.

In PCT Publication No. WO 2010/141969 A2, a device for connecting electrical cables on essential tubular connection elements, which can be screwed to each other, is disclosed, in which a first electrical contact element is firmly arranged on a first connection element and a second electrical contact element is arranged on a second connection element so as to be displaceable in the direction of rotation of the connection element. By means of this device, a problem of the electrical connection between the pipes of the drill string may be solved. The electrical connection has turned out to be reliable, simple and robust for the mechanical connection of pipes (e.g., a rotary movement) and enables a transmission of electric power and/or data under the severe conditions prevailing in the bore, such as a high pollution, the presence of all kinds of liquids, high temperatures and mechanical shocks. Using a drill string constructed in this manner, it is possible to feed electric power into underground measuring units during a drilling process, for example, with the aid of slip ring assemblies arranged at the top-drive and acting as swivels and to read out and evaluate data generated by those underground measuring units.

However, in particular for increasing the safety of the bore, it is also necessary to provide energy supply for underground measuring units and to read out data when no drilling operation is performed and the drill string is dismantled (trip-out) or installed by pipes being assembled (trip-in). In addition, it is of utmost importance to know whether changes relevant to safety occur in the bore, such as, e.g., pressure changes, friction, formation of gas bubbles etc.

In European Patent No. EP 2,273,058 A2, instruments for providing communications with a wired drill pipe during a tripping operation are disclosed. The instruments can be connected to the drill string and comprise so-called sub-coupler heads. A first type of sub-coupler head has a threadless surface which, during the installation in a wired drill pipe, exerts a retaining force against a thread section of the drill pipe via a friction or press fit. The friction or press fit is achieved by spreading the sub-coupler head. A communication element is embedded in the sub-coupler head to couple communicatively to a pipe communication element, if the sub-coupler head is positioned within the receiver end of the wired drill pipe. Inductive couplers and direct connection couplers, among other things, are mentioned as communication elements. A wiring connection, mud-pulse telemetry, electronic telemetry and/or acoustic telemetry are cited as examples of communicative coupling. The material of the sub-coupler head is elastic or deformable, respectively, and soft with regard to the material of the drill pipe so that the thread of the drill pipe is not damaged. In an alternative exemplary embodiment of the sub-coupler head, its surface exhibits a partial thread. The communication device serves only for the transmission of signals, but not for supplying underground measuring units with electric energy.

In U.S. Pat. No. 7,198,118, a communication adapter for a detachable connection to a drilling component outside of the active drilling operation is disclosed. The communication adapter comprises a data transmission coupler for data communication with a transmission system integrated in the drilling component, a mechanical coupler for removably attaching the adapter to the drilling component and an integral data interface comprising a screen, a gauge, a loudspeaker or a light. The mechanical coupler comprises a thread or solenoids or locking mechanisms such as, e.g., elastic clips or clamps. In one exemplary embodiment, the mechanical coupler comprises cams which can be swiveled about a swivel axis into an engagement with an internal thread of the drilling component. The communication adapter serves only for the transmission of signals, but not for supplying underground measuring units with electric energy.

The intention of feeding energy, data and/or control signals into and, respectively, out of the drill string during the trip-in and, respectively, trip-out operation of the bore encounters primarily the following difficulties:

- The drill string is not regularly screwed to the slip ring assembly, which, therefore, cannot be used for electrical power supply and communications.
- For safety reasons, electric energy supply units, data processing devices and controls are located outside of the drilling rig in a switch cabinet and they must be connected to the drill string via energy supply, status and control lines.
- The energy supply, status and control lines must be linked to the drill string via an electromechanical unit which functions highly reliably under the severe operating conditions and in accordance with safety regulations such as those for explosion protection zone 1 and yet is easy to handle for the operating staff, whereby semi-automatic or manual connecting and separating should be possible.

The disclosed technology is based on the object of providing a solution to the above-discussed problems associated with feeding electric energy, data and/or control signals into and, respectively, out of the drill string during the trip-in and, respectively, trip-out operation of the bore.

SUMMARY

Various implementations of systems, methods and devices within the scope of the appended claims each have several aspects, no single one of which is solely responsible for the desirable attributes described herein. Without limiting the scope of the appended claims, some prominent features are described herein.

The disclosed technology provides a device for connecting at least one electrical data and/or supply line to drill pipe electrical sockets of a wired drill pipe, when the wired drill pipe is not in an active drilling operation.

The disclosed technology also provides a method of connecting at least one electrical data and/or supply line to drill pipe electrical sockets of a wired drill pipe, when the wired drill pipe is not in an active drilling operation.

These and other objects of the disclosed technology will be described in or be apparent from the following description of the preferred embodiments.

According to an aspect of the disclosed technology, there is provided a device comprising electrical sockets galvanically connecting to the at least one electrical data and/or supply line and contacting with the drill pipe electrical sockets. The device further comprises a collet blocking plug configured to be axially insertable into and removable from a receiver end of the drill pipe and at least one collet configured to be axially displaceable from the collet blocking plug between a locking position and a release position. The collet is configured to be interlocked with the drill pipe in the locking position. The collet is released from the drill pipe in the release position.

According to an aspect of the disclosed technology, there is provided a method comprising connecting electrical sockets galvanically to the at least one electrical data and/or supply line and contacting with the drill pipe electrical sockets. The method further comprises interlocking at least one collet with the drill pipe in a locking position and releasing the collect from the drill pipe in a release position. The collet is configured to be axially displaceable from a collet blocking plug between the locking position and the release position. The collet blocking plug is configured to be axially insertable into and removable from a receiver end of the drill pipe.

Said object is achieved by a device for connecting at least one electrical data and/or supply line to electrical sockets of a wired drill pipe having the features of claim 1. Advantageous embodiments are set forth in the subclaims, in the specification and in the drawings.

By means of the tripping sub, according to an embodiment, at least one electrical data and/or supply line can be connected to electrical sockets of a wired drill pipe, if the drill pipe is not in the active drilling operation. The tripping sub according to an embodiment comprises: electrical sockets which are galvanically connected to the at least one electrical data and/or supply line and can be brought into contact with the electrical sockets of the drill pipe; a collet blocking plug axially insertable into and removable from a receiver end of the drill pipe; and at least one collet. The collet blocking plug and the collet are axially displaceable relatively to each other between a collet position and a release position, wherein, in the collet position, the collet is configured to interlock with the drill pipe and wherein, in the release position, the engagement of the collet with the drill pipe is undone.

The tripping sub according to an embodiment is particularly suitable for being connected to the connection elements of wired drill pipes as described in the above mentioned patent application WO 2010/141969 A2, whereas an adjustment to standard threads of standard drill pipes is not an object of the embodiments.

A locking between the tripping sub according to an embodiment and the drill pipe which is fabricable quickly and safely can be achieved if the collet is radially movable, preferably radially movable in an elastic way.

If, in the tripping sub according to an embodiment, the collet is radially retractable in the release position, the tripping sub can be guided out of the drill pipe with particular ease. In a preferred construction of an embodiment, the collet blocking plug has at least one indentation, preferably at least one peripheral groove, into which the collet is radially retractable in the release position. Particularly safe handling of the tripping sub according to an embodiment can be achieved if the collet blocking plug has two indentations, preferably peripheral grooves, which are axially offset and define two different release positions. A first release position is thereby taken by a relative axial displacement of the collet blocking plug toward the collet in a first direction, and a second release position is taken by a relative axial displacement of the collet blocking plug toward the collet in the opposite direction. A high mechanical stability of the connection between the tripping sub and the wired drill pipe and protection against loosening of the connection in the occurrence of tensile forces is achieved if, in the collet position, a section of the collet blocking plug forms an abutment against radial retraction of the collet.

Good manageability of the tripping sub according to an embodiment is achieved if the collet has projections which are configured to join in indentations of the drill pipe in the collet position or if the collet has indentations which are configured to join in projections of the drill pipe in the collet position.

In a space-saving and mechanically highly reliable embodiment of the tripping sub according to an embodiment, the collet is designed as a clamping sleeve surrounding the collet blocking plug.

In order to prevent an unintended loosening of the connection to the drill pipe, the tripping sub can be prestressed into the collet position, preferably by means of centering springs.

For a particularly high reliability and a fast establishing of the electrical connection, in a preferred embodiment of the tripping sub according to an embodiment, a rotary external body is provided in which the electrical sockets are configured such that they can be brought into contact with the electrical sockets of the drill pipe by a rotary movement of the external body. Providing rotation handles facilitates the turning of the tripping sub for the operating staff. Providing axial running handles generally simplifies the manual guidance of the tripping sub. In a preferred embodiment, the external body and the collet are axially connected with regard to each other in an essentially rigid, but rotatable way. The connection can thereby be implemented by means of a rotation blocking plug which is axially connected to the collet in a rigid way and, on its outer surface, has an external thread onto which an internal thread of the external body is screwed in a rotatable way. The collet and/or the rotation blocking plug can be locked against twisting with regard to the collet blocking plug by a rotation blocking element. Alternatively, the rotation blocking plug can comprise rotation blocking elements for join in the drill pipe.

For an automatic or at least semiautomatic connection of the tripping sub to a drill pipe, it is envisaged that the external body is rotatable by means of a motor and optionally a gear, wherein the tripping sub preferably being equipped with actuators for an automatic supply to and take away from the drill pipe.

Furthermore, for safety reasons, an electrical detection switch is recommended which detects whether the electrical sockets of the tripping sub are in contact with the electrical sockets of the drill pipe.

In order to avoid that the electrical cables twist too much and, as a result, break or their insulation is damaged, it is also envisaged in an embodiment that at least one electrical cable is guided out of the tripping sub in a loom of cables by means of a rotation compensator device.

For conducting measurements, for example, on stored drill pipes, it is purposeful to design the tripping sub according to an embodiment as a handheld device, wherein at least one device for feeding and discharging data, status and/or test signals and for evaluating discharged signals is connected to the at least one electrical data and/or supply line, the device preferably having a user interface.

BRIEF DESCRIPTION OF THE DRAWINGS

FIG. 6B shows a detailed view of FIG. 6A. FIG. 11B shows a detailed view of FIG. 11A.

Figure 1:
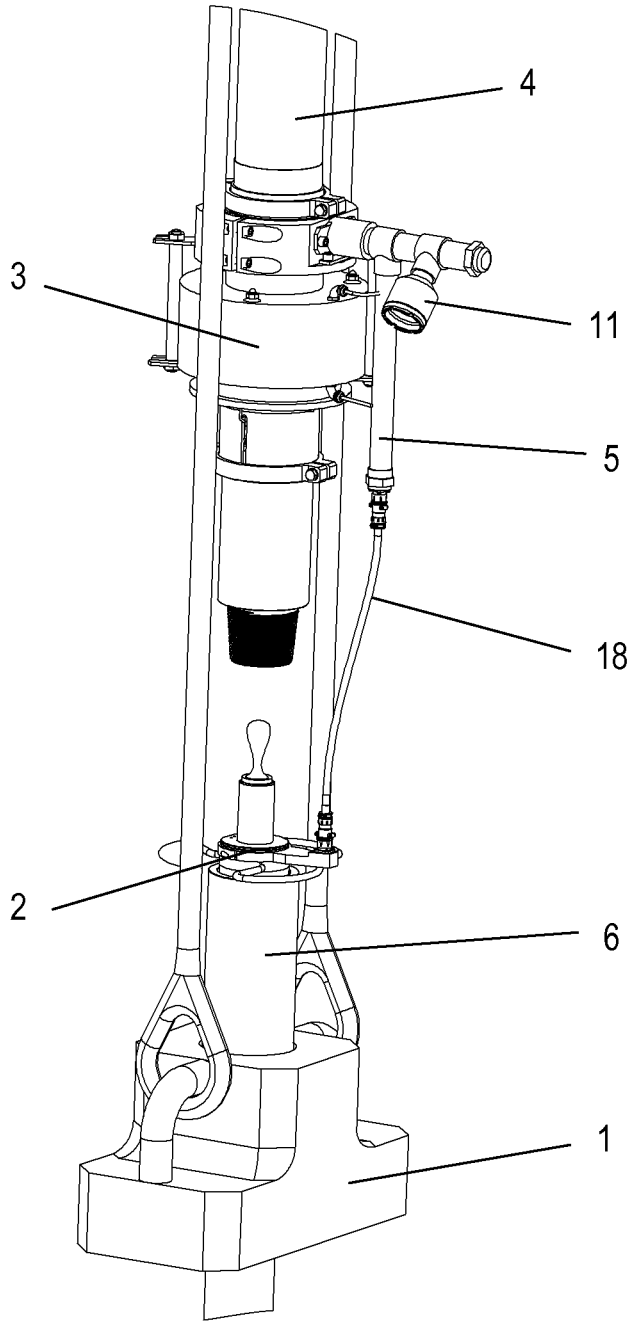
FIG. 1 shows a detail of a drilling facility comprising a tripping sub, in accordance with an exemplary embodiment.

The various features illustrated in the drawings may not be drawn to scale. Accordingly, the dimensions of the various features may be arbitrarily expanded or reduced for clarity. In addition, some of the drawings may not depict all of the components of a given system, method or device. Finally, like reference numerals may be used to denote like features throughout the specification and figures.

DETAILED DESCRIPTION

Advantages and features of the disclosed technology and methods of accomplishing the same may be understood more readily by reference to the following detailed description of preferred embodiments and the accompanying drawings. The disclosed technology may, however, be embodied in many different forms and should not be construed as being limited to the embodiments set forth herein. Rather, these embodiments are disclosed so that this disclosure will be thorough and complete and will fully convey the concept of the invention to those skilled in the art, and the disclosed technology will only be defined by the appended claims. Like reference numerals refer to like elements throughout the specification.

The drawings and description are to be regarded as illustrative in nature and not restrictive. Like reference numerals designate like elements throughout the specification.

Further, since sizes and thicknesses of constituent members shown in the accompanying drawings are arbitrarily given for better understanding and ease of description, the disclosed technology is not limited to the illustrated sizes and thicknesses.

FIG. 1 shows a detail of a drilling facility for crude oil, natural gas or geothermal drillings, wherein measuring units arranged at the wired drill string are supplied, via the wiring, with electric energy, control signals and/or data that are sent by the measuring units, via the wired drill string, to control and evaluation devices located above ground. The data transmission also takes place when no drilling operation is performed. But, as is illustrated here, the drill string is demounted (trip-out) or installed by pipes assembled (e.g., trip-in). In FIG. 1, a grabber assembly 1 is shown to hold a topmost wired drill pipe 6 of a wired drill string. The upper end, the so-called "box-end," of the wired drill pipe 6 is referred as a device 2 for connecting electrical data and/or supply lines arranged in a flexible part of a data cable housing sleeve 18. The data cable housing is connected to electrical sockets of the wired drill pipe 6. The wired drill pipe 6 is preferably a drill pipe comprising a connection element as described in PCT Patent Publication No. WO 2010/141969 A2. The flexible part of the data cable housing sleeve 18 leads to a data cable housing sleeve 5. The data cable housing sleeve 5 is fixed to a swivel body 3. The electrical cables continue from the data cable housing sleeve 5 to a wired mounting sub 4 and proceed to control and evaluate energy supply devices located remotely from the drilling facility. Because of this arrangement, it is possible to control electric circuits located in the drill string and to supply them with energy. During a drilling operation of the drilling facility, the tripping sub 2 is parked in a box 11 so that it neither disturbs the drilling operation, nor can it get damaged. As such, the tripping sub 2 will immediately be available again in subsequent tripping operations. During the drilling operation, the wired mounting sub 4 is directly connected to the wired drill pipe 6.

Figure 2:
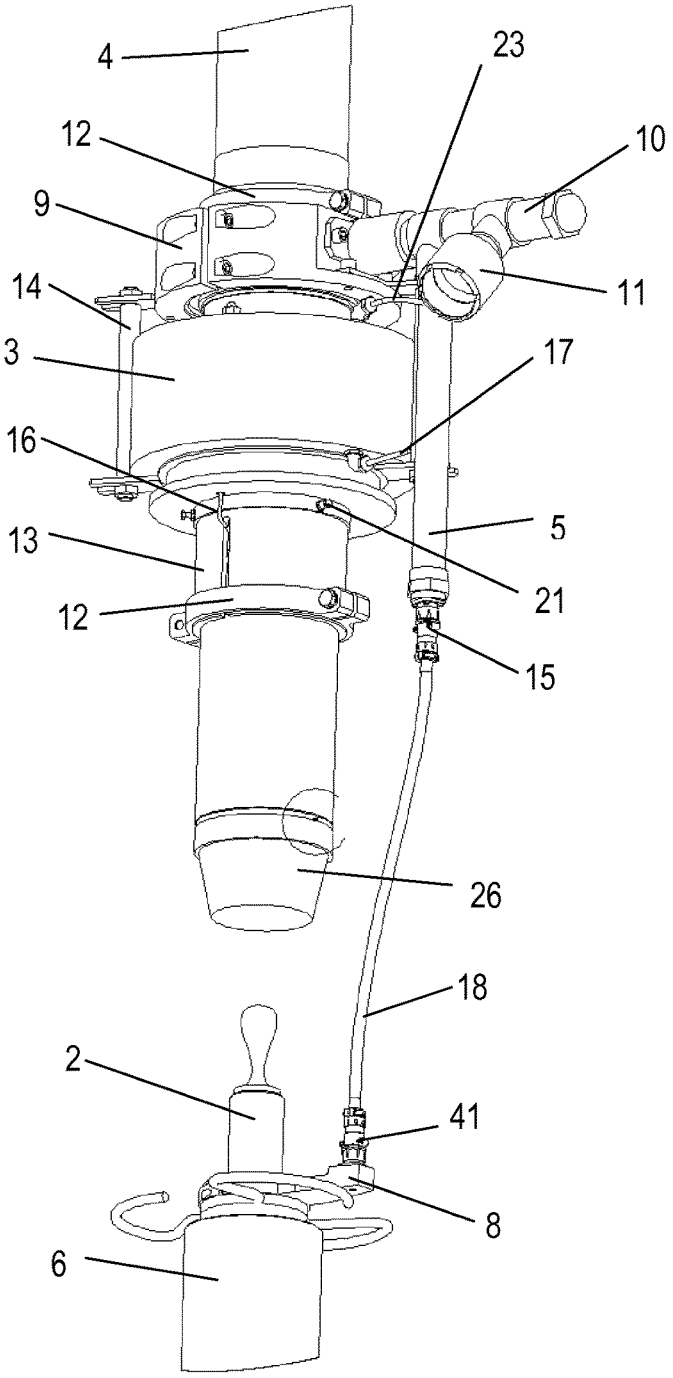
FIG. 2 shows the connection of the tripping sub 2 to a swivel body and a wired drill pipe, in accordance with an exemplary embodiment.

FIG. 2 shows a connection of the tripping sub 2 to a swivel body 3 and the wired drill pipe 6 in an enlarged illustration, in accordance with an exemplary embodiment. With screws 21, the swivel body 3 is mounted to a split bushing 13. The split bushing 13 is retained on the wired mounting sub 4 with the aid of binding clips 12. For connecting the swivel body 3 to the wired drill string during a drilling operation, an electrical cable 16 is guided through the split bushing 6. Above the electrical swivel body 3, a bearing mount unit 9 is mounted rotatably to the split bushing 13. A synchronizing system 14 connects the bearing mount unit 9 and the swivel body 3 in a torque-proof manner to each other so that they may rotate relative to the wired mounting sub 4 only jointly. A bar-shaped holder 10 projects radially outwards from the bearing mount unit 9. The box 11 for the tripping sub 2 and the data cable housing sleeve 5 are affixed to the holder 10. An input electrical cable 23 and an output electrical cable 17 run out of the swivel body 3 and run into the data cable housing sleeve 5 via a slip ring assembly located in an interior of the swivel body 3, which is not illustrated here. The input electrical cable 23 and the output electrical cable 17 also run from there into the flexible part of the data cable housing sleeve 18. The data cable housing sleeve 18 is attached to the data cable housing sleeve 5 via a socket plug connector 15. During remodeling operations (e.g., tripping operations), the input electrical cable 23 and the output electrical cable 17 are galvanically connected to the wired drill pipe 6 via the tripping sub 2. During the remodeling operations, the end of the wired mounting sub 4 is protected by a protection cap 26. In order that the flexible part of the data cable housing sleeve 18 does not twist when the tripping sub 2 is being used, the flexible part of the data cable housing sleeve 18 ends in a device for compensating rotation 8 of the tripping sub 2, using a socket plug connector 41.

Figure 3:
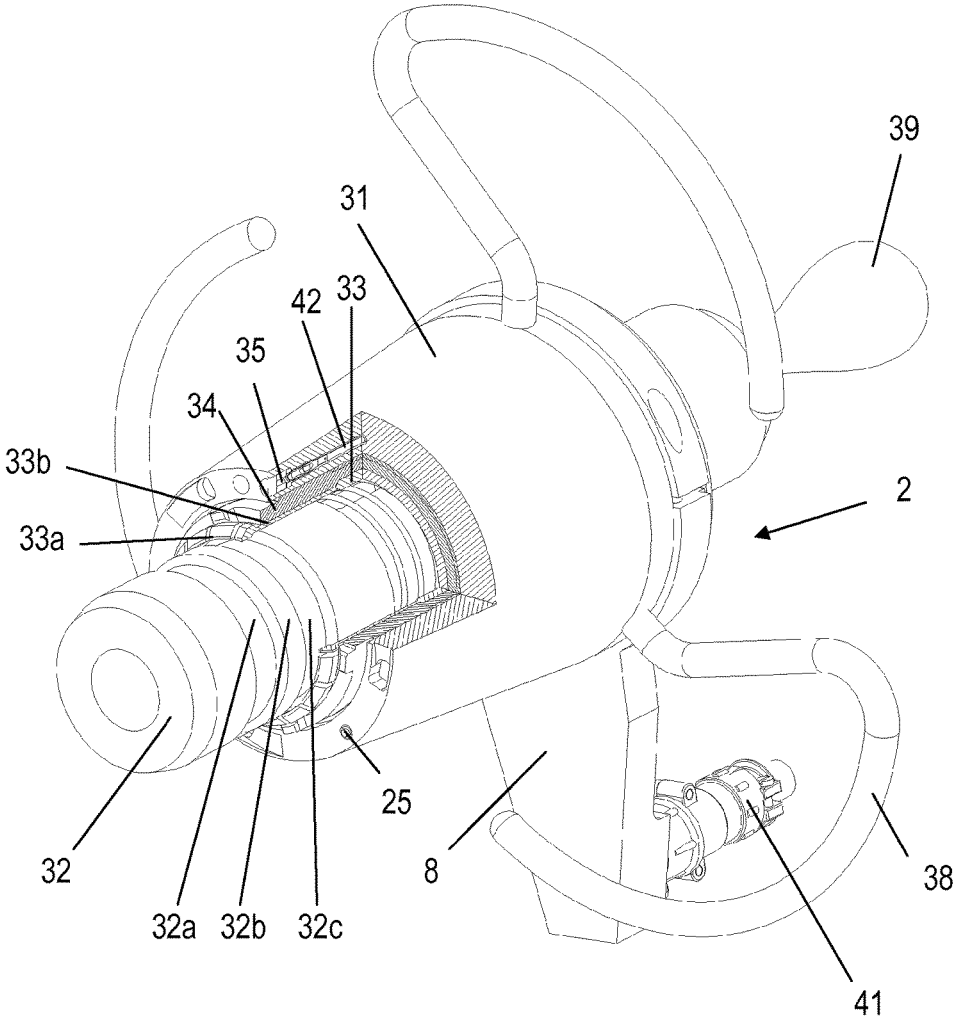
FIGS. 3 and 4A show an embodiment of the tripping sub in a perspective illustration, in each case partially sectioned.
Figure 4A:
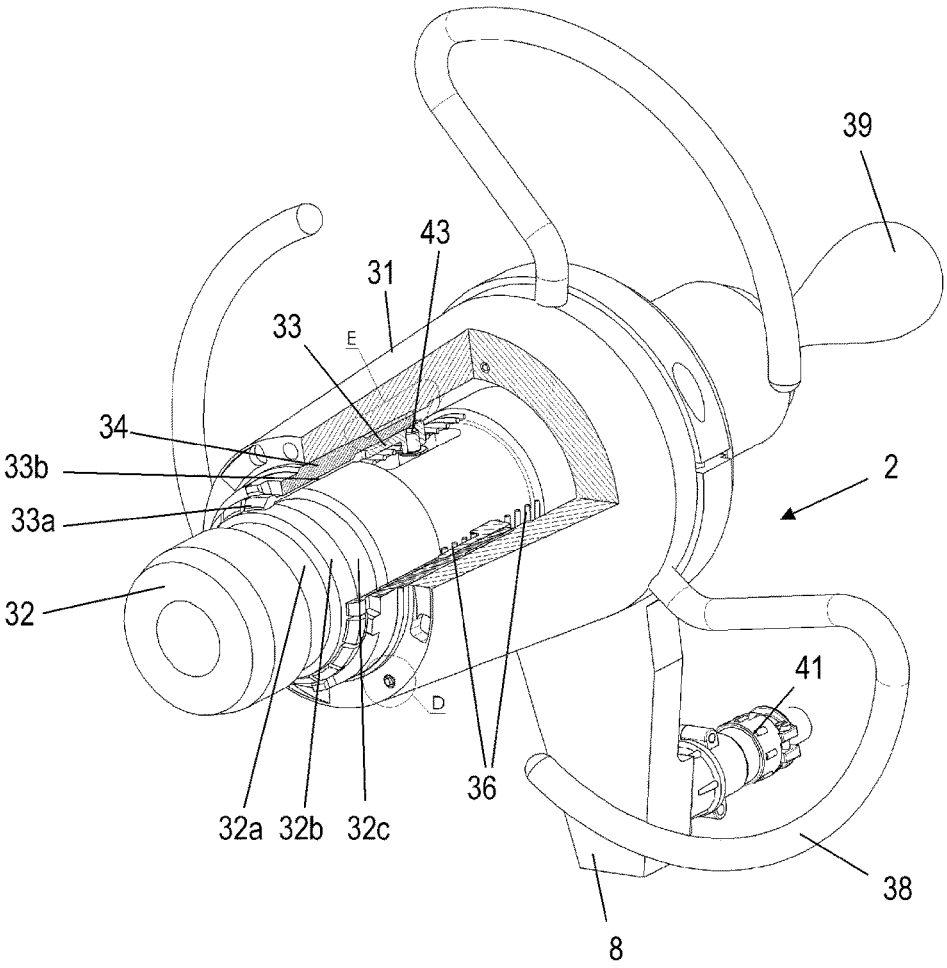

FIG. 3 and FIG. 4A show an exemplary embodiment of the tripping sub 2 in a perspective illustration, in each case partially sectioned. The tripping sub 2 comprises an essentially frustoconical external body 31 from which an axial running handle 39 for the manual axial guidance of the tripping sub 2 and three rotation handles 38 for manually rotating the external body 31 extend for easier handling during an insertion into the drill pipe. The external body 31 is configured such that it creates protection against the infiltration of drilling mud. The external body 31 is also constructed in an explosion-proof way. Furthermore, the device for compensating rotation 8 extends from the external body 31 in a rotatable way. The rotation 8 has already been illustrated above, on which the socket plug connector 41 may be seen. At a front face which faces the drill pipe of the external body 31, an electrical detection switch 25 is arranged (see in particular detail D in FIG. 4C). The electrical detection switch 25 detects whether the electrical sockets 35 of the tripping sub 2 have been brought into contact with the electrical sockets of the drill pipe. The electrical sockets 35 may be designed as standard electrical sockets which end to the front face of the external body 31, and the electrical sockets of the drill pipe extend axially in the form of contact pins. Electrical cables 42 run from the electrical sockets 35 through the interior of the tripping sub 2 to the socket plug connector 41. A rotation blocking plug 34, a collet 33 in the form of a clamping sleeve and a collet blocking plug 32 are arranged within the external body 31 in coaxial orientation thereto from the outside to the inside.

The collet 33 serves for fixating the tripping sub 2 in the drill pipe in an axial direction. For this purpose, the collet blocking plug 32 and the collet 33 are axially displaceable relative to each other between a locking position and a release position, with the collet 33 being divided in its front region into a plurality of tongues 33*b*. The tongues 33*b* are radially movable in an elastic way and, at their free ends, exhibit projections 33*a* for interlocking with the drill pipe. In a collet position, the tongues 33*b* are extended radially. In a release position, they are retracted radially, as it is explained below in further detail. The collet blocking plug 32 has two indentations in the form of peripheral grooves 32*a* and 32*c*, which are separated from each other by a web-shaped section 32*b* and receive the projections 33*a* of the collet 33 in two different release positions.

Figure 4B:
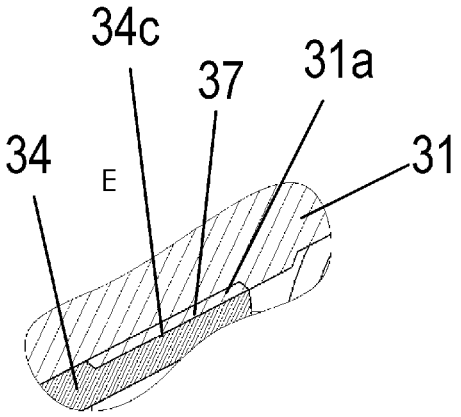
FIGS. 4B and 4C show detailed views E and D, respectively, of FIG. 4A.
Figure 4C:
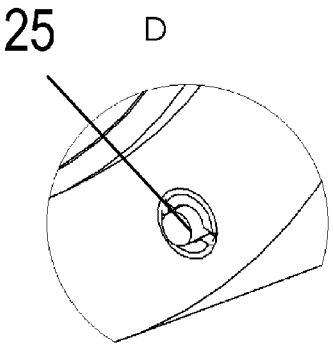

The collet 33 is axially mounted in a rigid way with regard to the rotation blocking plug 34 so that axial movements of the collet 33 and axial movements of the rotation blocking plug 34 take place jointly, whereby the rotation blocking plug 34 is unable to obstruct the radial movement of the tongues 33*b*. As shown in FIG. 4B, a buttress thread 37 comprises an external thread 34*c* on the peripheral surface of the rotation blocking plug 34 and an internal thread 31*a* on the interior surface of the external body 31. With the buttress thread 37, the rotation blocking plug 34 and the external body 31 are interconnected in such a way that the rotation blocking plug 34, the collet 33 and the external body 31 are axially moved jointly in relation to the collect blocking plug 32 if the external body 31 is moved axially. However, in a rotary movement of the external body 31 in relation to the collet 33, the external body 31 is movable axially in relation to the collet 33. With two central springs 36, the rotation blocking plug 34, the collet 33 and the external body 31 are prestressed into such an axial position relative to the collet blocking plug 32 that the tripping sub 2 is located in the locking position in which the projections 33*a* of the collet 33 rest on the web section 32*b* of the collet blocking plug 32. The two central springs 36 exert equal spring forces from opposite directions, whereby an equilibrium of forces is produced and results in the relative axial position.

The rotation blocking plug 34 serves for radially fixating the tripping sub 2 in the drill pipe. For this purpose, the rotation blocking plug 34 exhibits, at its front face, a sequence of projections 34*a* and indentations 34*b* which interlock with indentations and projections of a protective sleeve in the drill pipe, which are formed in a mirror-inverted fashion. In order to prevent that the collet 33 and the rotation blocking plug 34 twist with regard to the collet blocking plug 32, a rotation blocking pin 43 is provided. As a result of this construction, the collet 33 and the rotation blocking plug 34 are secured radially and axially in relation to the drill pipe in the state of connection between the tripping sub 2 and the drill pipe.

Figure 5:
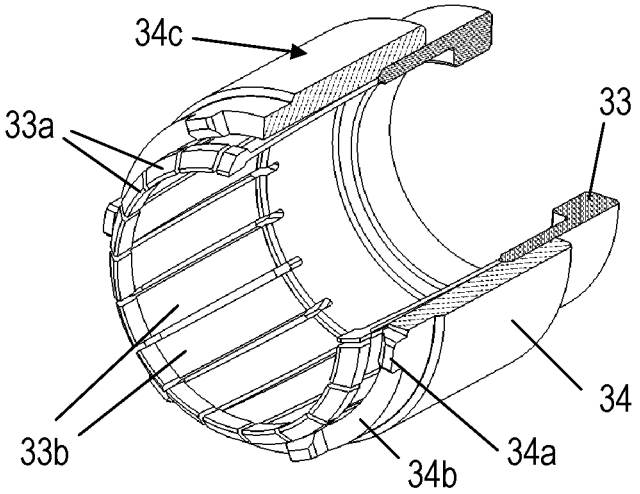
FIG. 5 shows an arrangement of a collet and a rotation blocking plug in the tripping sub.

FIG. 5 shows the arrangement of the collet 33 and the rotation blocking plug 34. In this figure, the plurality of tongues 33*b* with the projections 33*a* and the front-end projections 34*a* and indentations 34*b* may be seen particularly well. For the sake of clarity, the external thread 34*c* on an outer surface of the rotation blocking plug 34 is not depicted graphically, but is annotated by reference numeral 34*c*.

Figure 6A:
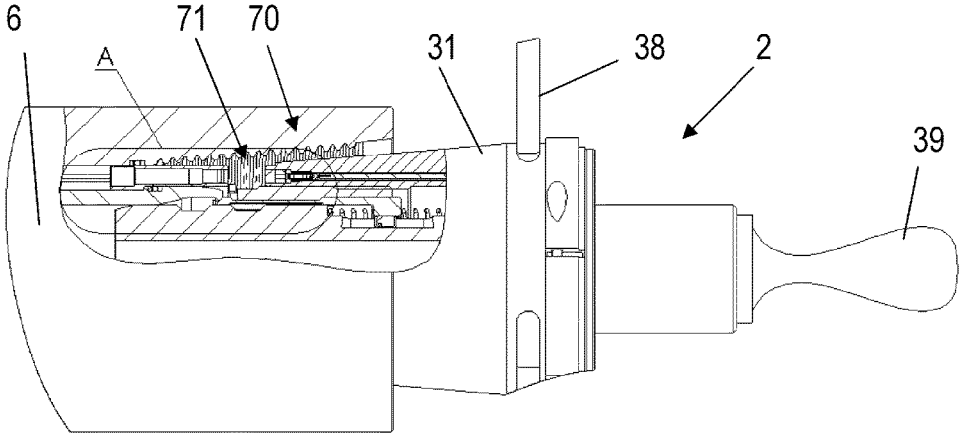
FIGS. 6A, 6B, 7-10, 11A, and 11B show the process of connecting the tripping sub to the drill pipe, in accordance with an exemplary embodiment.
Figure 6B:
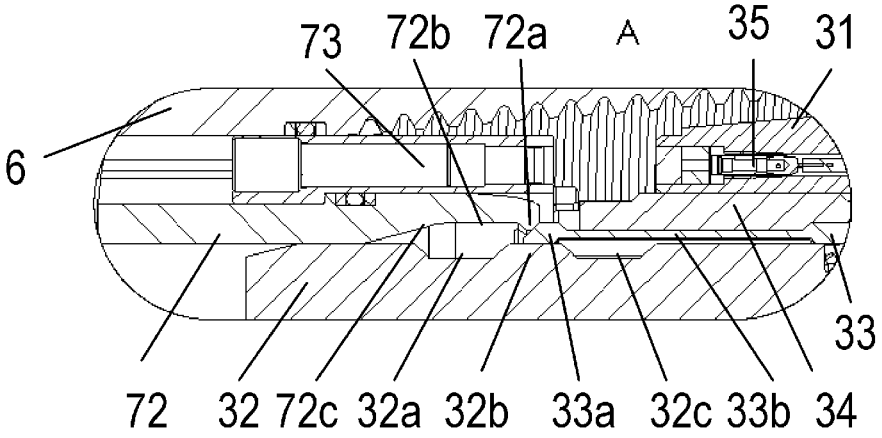
Figure 7:
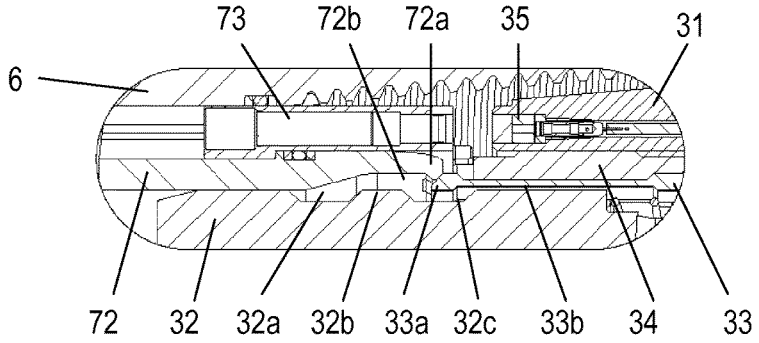
Figure 8:
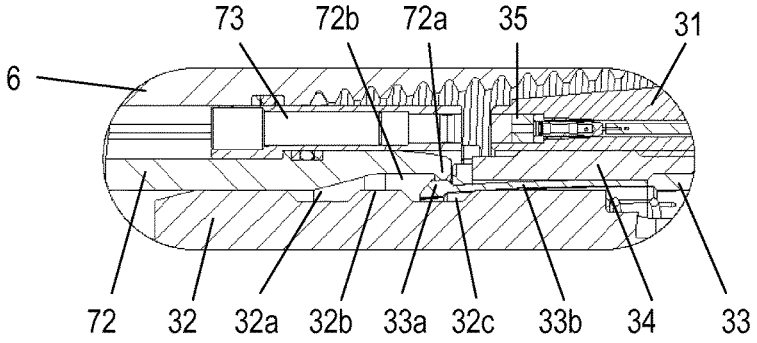
Figure 9:
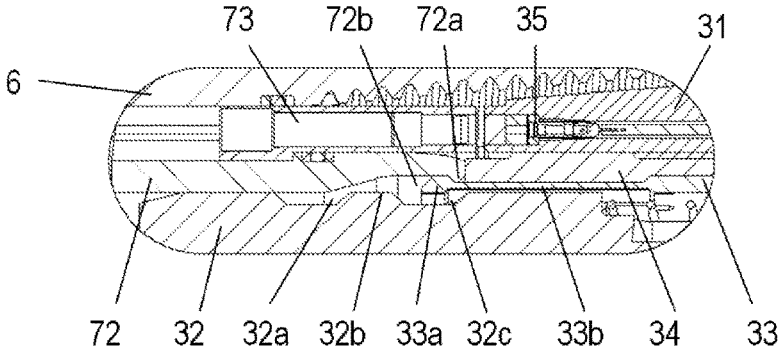
Figure 10:
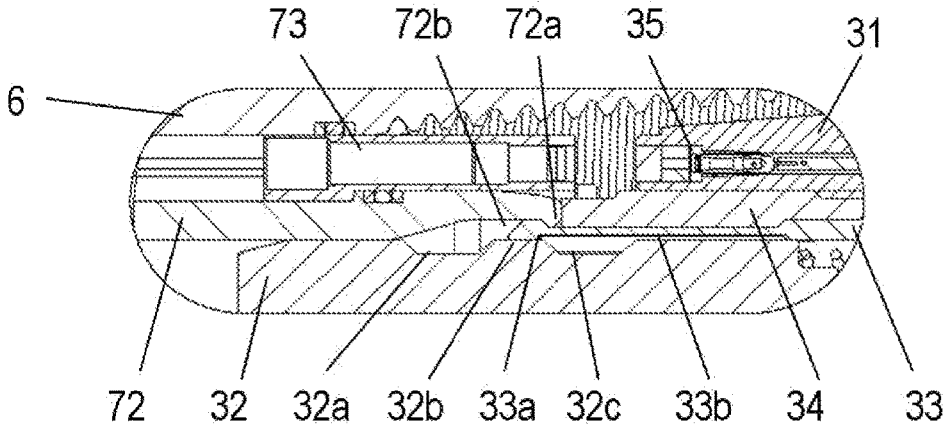
Figure 12:
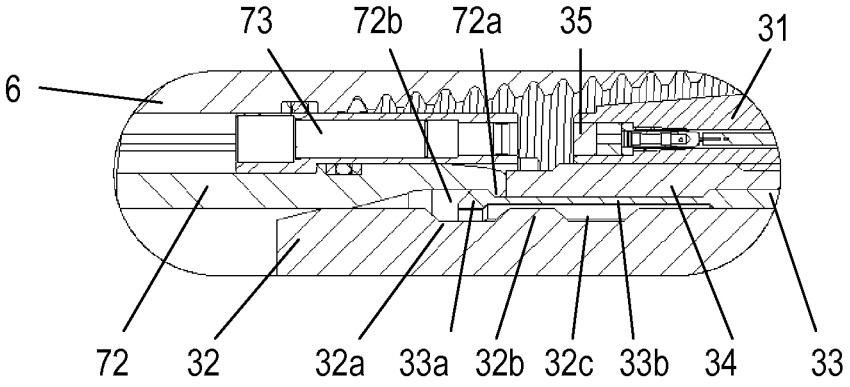
FIGS. 12 and 13 show a process of loosening the connection of the tripping sub to the drill pipe, in accordance with an exemplary embodiment.
Figure 13:
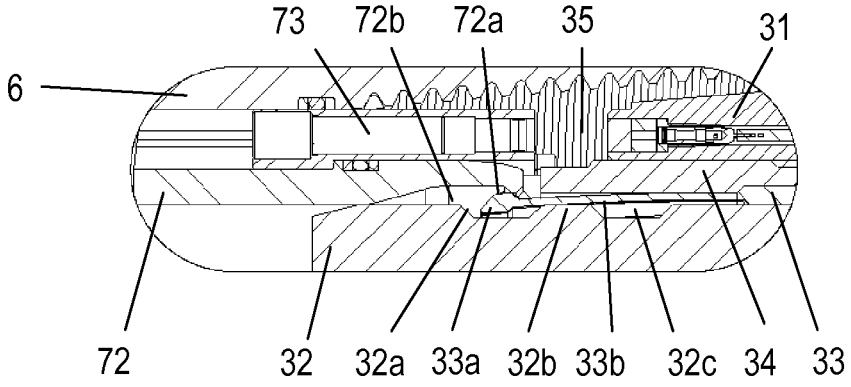

In the following, a process of connecting the tripping sub 2 to the drill pipe 6 is explained on the basis of FIGS. 6A, 6B, 7-10, 11A, and 11B, and the subsequent loosening of said connection is explained on the basis of FIGS. 12 and 13. FIG. 6A shows an initial insertion of the external body 31 into a conical receiving space 71 of a box end 70 of the wired drill pipe 6, with FIG. 6B, detail A, showing an enlarged illustration of a cutout of FIG. 11A. The drill pipe 6 comprises electrical sockets 73 (pins) for a galvanic connection to the electrical sockets 35 (e.g., bushings) of the tripping sub 2. At the box end 70, a sleeve-shaped connection element 72 is arranged. The sleeve-shaped connection element 72 comprises a ring-shaped lug 72*a* facing the tripping sub 2, a ring-shaped indentation 72*b* formed behind the lug 72*a* as well as a conical central surface 72*c*. When the tripping sub 2 is inserted axially with the aid of the axial running handle 39, the tapered front end of the collet blocking plug 2 is axially centred through the central surface 72*c*. Because of the prestressing by means of the central springs 36 as explained above (see, e.g., FIG. 4A), the tripping sub 2 is located in a locking position in which the projections 33*a* of the collet 33 rest on the web-shaped section 32*b* of the collet blocking plug 32. As a result, the projections 33*a* abut against the lug 72*a* of the connection element 72 of the drill pipe 6 during the insertion of the tripping sub 2, whereby a further axial movement of the collet 33 is initially prevented. However, as shown in FIG. 7, the collet blocking plug 32 may move well further into the drill pipe 6 in the axial direction, whereby the web-shaped section 32*b* of the collet blocking plug 32 moves away from the projections 33*a* and the second peripheral groove 32*c* of the collet blocking plug 32 comes into alignment with the projections 33*a*. As shown in FIG. 8, the peripheral groove 32*c* provides a free space necessary for an elastic radial inward movement to the tongue 33*b* with its projections 33*a* in that the lug 72*a* presses the projections 33*a* inwards. In this manner, the collet 33 may axially move further forward, while the projections 33*a* glide through underneath the lug 72*a* and reach the indentation 72*b* of the connection element 72. As shown in FIG. 9, the indentation 72*b* provides free space for the projections 33*a*, whereby the tongues 33*b* may move back into their radial starting position. When the axial insertion movement of the connection element 2 stops, the collet blocking plug 32 moves slightly back into its equilibrium position as a result of the prestressing by the central springs 36, in which position the web-shaped section 32*b* again constitutes an abutment to the projections 33*a* so that they are prevented from a radial inward movement, whereby the locking position is taken, see FIG. 10.

Figure 11A:
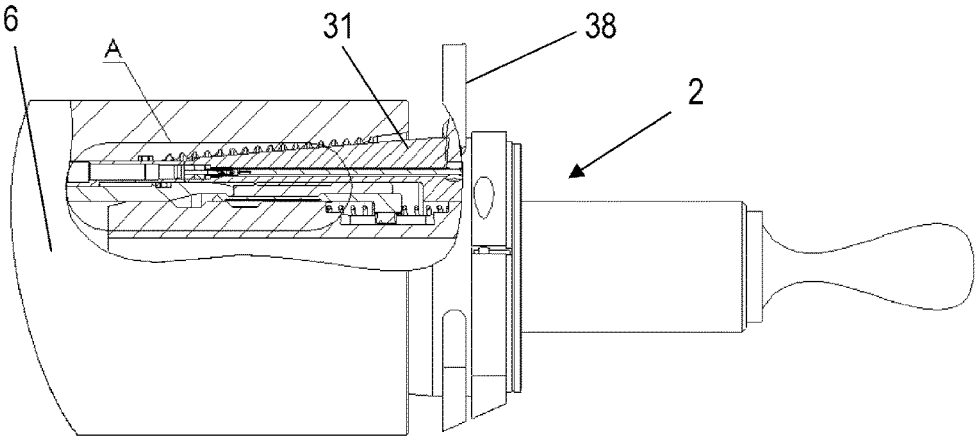
Figure 11B:
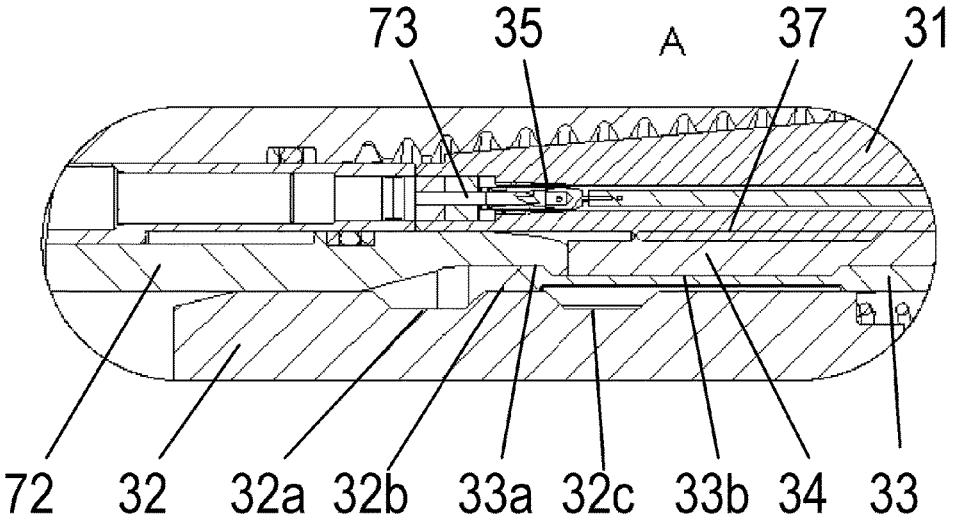

As shown in FIGS. 11A and 11B, using the rotation handles 38, the external body 31 of the tripping sub 2 is rotated so that the electrical sockets 35 (e.g., bushing) of the tripping sub 2 come into an axial alignment with the electrical sockets 73 (e.g., electrical contact pins) of the drill pipe 6. The fixation of the external body 31 in its axial position (i.e., against the spring pressure of pressure plates in the interior of the drill pipe 6) is performed with the buttress thread 37. This position with galvanically connected electrical sockets 35 and 73 constitutes a working position connecting the connection element 2 to the drill pipe 6 during remodelling operations.

In order to loosen a connection between the drill pipe 6 and the tripping sub 2, the above described operations are conducted in the reverse order. That means that at first, by rotating the external body 31 in the opposite direction, the axial fixation thereof has to be loosened. An interruption of the galvanic contact of the electrical sockets 35 and 73 occurs by loosening the axial fixation of the external body. By pulling the axial running handle 39, the collet blocking plug 32 axially moves outwards in relation to the collet 33, since the collet 33 is prevented from an axial movement because its projections 33*a* abut against the lug 72*a* of the connection element 72 of the drill pipe. As shown in FIG. 12, with a relative displacement between the collet blocking plug 32 and the collet 33, the first peripheral groove 32*a* comes into alignment with the projections 33*a*. As such, the projections 33*a* may be pressed radially inwards into the peripheral groove 32*a* by the lug 72*a*, as shown in FIG. 13, whereby the locking of the collet 33 loosens and the latter may also be moved axially outwards in an unhindered fashion.

The exemplary embodiment of the tripping sub 2 according to an embodiment, as it has been described so far, is provided for the manual operation of the drilling facility by the operating staff. However, it is also possible to furnish the tripping sub 2 for a semiautomatic or fully automatic operation.

Figure 14:
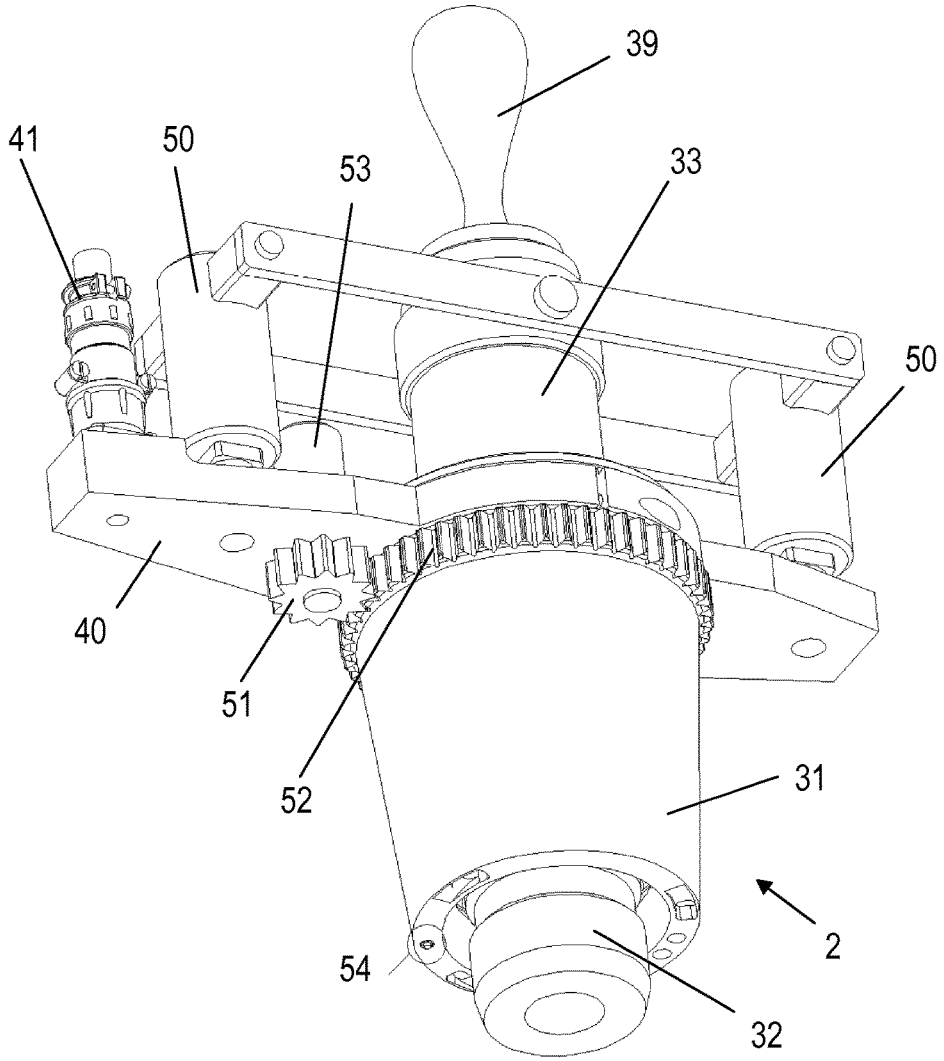
FIG. 14 shows an exemplary embodiment of the tripping sub having a motor drive.

FIG. 14 shows an exemplary embodiment of the tripping sub 2 which is provided with a motor drive for rotating the external body 31. A motor 53 rotates the external body 31 in relation to the collet blocking plug 32 via a gear comprising a pinion gear 51 on the driving shaft of the motor 53 and a gear ring 52 on the outer surface of the external body 31. With external drives 50, the axial movement of the external body 31 in relation to the collet blocking plug 32 is controlled. In some exemplary implementation, the external drives 50 are implemented as hydraulic or pneumatic cylinder-piston systems or as threaded spindles. The drives 50 are located on a rotation compensator device 40 to which also the socket plug connector 41 is attached. Also in this exemplary embodiment, an electrical detector switch 54 is provided which detects whether the external body 31 has been rotated into a correct angular orientation in relation to the drill pipe, in which a galvanic connection between the electrical sockets of the tripping sub and of the drill pipe occurs. The final fixation of the external body 31 by the external drives 50 occurs in this correct angular orientation.

Figure 15:
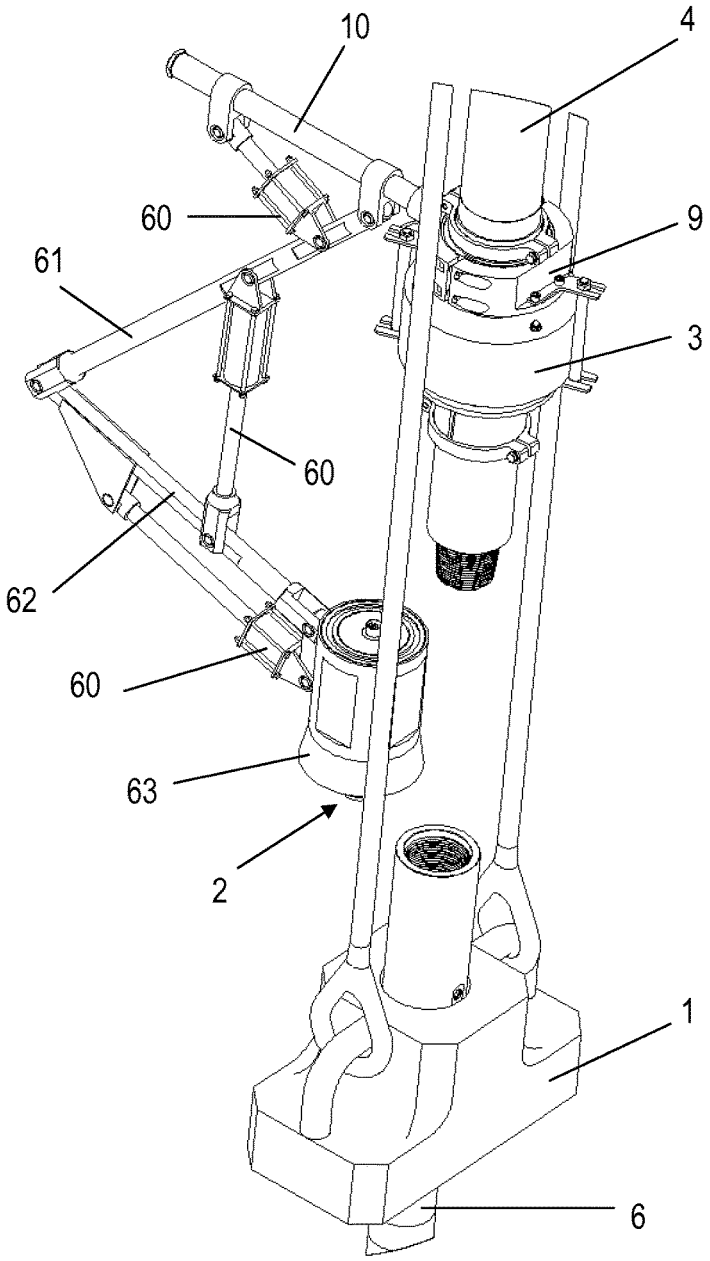
FIG. 15 shows a furnishing of the tripping sub with devices for automatic placement.

FIG. 15 shows a furnishing of the tripping sub 2 with devices for automatically placing the tripping sub 2 on the drill pipe 6, while it is being held by a grabber assembly 1. For this purpose, the tripping sub 2 is accommodated in a housing 63 mounted on the holder 10 via actuator arms 61 and 62 and the holder 10 is fixed to the swivel body 3 via the bearing mount unit 9. The wired mounting sub 4 extends from the swivel body 3. The actuator arms 61 and 62 are guided to and from the drill pipe 6 by actuators 60 in a three-dimensional movement. The housing 63 has a conical open end which facilitates the placement on the drill pipe 6 in a centred orientation. Distance meters may also be used for a more precise placement.

What is claimed is:

1. A device for galvanically connecting at least one electrical data and/or supply line to drill pipe electrical sockets of a wired drill pipe, wherein the wired drill pipe is not in an active drilling operation, the device comprising:

electrical sockets galvanically connecting to at least one electrical data and/or supply line, the electrical data and/or supply line being housed in a data cable housing sleeve external to the wired drill pipe, and contacting with electrical sockets of the wired drill pipe during trip-in or trip-out;

a collet blocking plug configured to be axially insertable into and removable from a receiver end of the drill pipe; and at least one collet configured to be axially displaceable from the collet blocking plug between a locking position and a release position, wherein, in the locking position, the collet is configured to be interlocked with the drill pipe, and wherein, in the release position, the collet is released from the drill pipe.

2. The device of claim 1, wherein the collet is radially movable.

3. The device of claim 2, wherein the collet is radially movable in an elastic way.

4. The device of claim 2, wherein the collet is radially retractable in the release position.

5. The device of claim 4, wherein the collet blocking plug has at least one indentation into which the collet is radially retractable in the release position.

6. The device of claim 5, wherein the at least one indentation is at least one peripheral groove.

7. The device of claim 5, wherein the collet blocking plug has two indentations, wherein the two indentations are configured to be spaced apart from each other axially and define a first release position and a second release position, wherein the first release position is taken by a relative axial displacement between the collet blocking plug and the collet in a first direction, and wherein the second release position is taken by a relative axial displacement between the collet blocking plug and the collet in a second direction which is opposite to the first direction.

8. The device of claim 2, wherein, in the locking position, a section of the collet blocking plug forms an abutment against a radial retraction of the collet.

9. The device of claim 1, wherein the collet comprises at least one of projections configured to join in indentations of the drill pipe in the locking position, or indentations configured to join in projections of the drill pipe in the locking position.

10. The device of claim 1, wherein the collet comprises a clamping sleeve surrounding the collet blocking plug.

11. The device of claim 1, further comprising central springs, wherein the collet is configured to interlock with the drill pipe with the central springs.

12. The device of claim 1, further comprising:

a rotary external body, wherein the electrical sockets are configured to contact with the drill pipe electrical sockets via a rotary movement of the external body, and at least one of rotation handles or axial running handles.

13. The device of claim 12, wherein an axial connection between the external body and the collet is configured to be in an essentially rigid but rotatable way.

14. The device of claim 13, wherein the connection is implemented by a rotation blocking plug, wherein the rotation blocking plug axially connects to the collet in a rigid way, and wherein the rotation blocking plug has an outer surface with an external thread onto which an internal thread of the external body is screwed in a rotatable way.

15. The device of claim 14, further comprising a rotation blocking element, wherein at least one of the collet or the rotation blocking plug is secured against twisting with regard to the collet blocking plug by the rotation blocking element.

16. The device of claim 14, wherein the rotation blocking plug comprises rotation blocking elements configured to join in the drill pipe.

17. The device of claim 12, further comprising actuators for an automatic supply to the drill pipe and a taking away from the drill pipe, wherein the external body is rotatable with at least one of a motor and a gear.

18. The device of claim 1, further comprising an electrical detection switch configured to detect whether the electrical sockets of the device are in contact with the electrical sockets of the drill pipe.

19. The device of claim 1, further comprising a rotation compensator device, wherein at least one of the electrical data and/or supply lines is guided out in a loom of cables via the rotation compensator device.

20. The device of claim 1, further comprising at least one handheld device, wherein the device is configured to feed and discharge at least one of data signals, status signals or test signals and to evaluate discharged signals, wherein the device is configured to connect to the at least one electrical data and/or supply line.

21. The device of claim 20, further comprising a user interface.

22. A method of galvanically connecting at least one electrical data and/or supply line to drill pipe electrical sockets of a wired drill pipe, when the wired drill pipe is not in an active drilling operation, the method comprising:

connecting electrical sockets galvanically to at least one electrical data and/or supply line, the electrical data and/or supply line being housed in a data cable housing sleeve external to the wired drill pipe, and contacting with electrical sockets of the wired drill pipe during trip-in or trip-out;

interlocking at least one collet with the drill pipe in a locking position; and releasing the collet from the drill pipe in a release position, wherein the collet is configured to be axially displaceable from a collet blocking plug between the locking position and the release position, and wherein the collet blocking plug is configured to be axially insertable into and removable from a receiver end of the drill pipe.

* * * * *